United States Patent [19]

Hoffman

[11] Patent Number: 4,898,352

[45] Date of Patent: Feb. 6, 1990

[54] CONTAINER STAND

[76] Inventor: Ronald W. Hoffman, 10431 West Catalina, Phoenix, Ariz. 85039

[21] Appl. No.: 309,217

[22] Filed: Feb. 13, 1989

[51] Int. Cl.[4] ..... A63B 55/00

[52] U.S. Cl. ..... 248/96; 206/315.7; 248/155; 248/588

[58] Field of Search ..... 248/291, 150, 165, 166, 248/439, 188.6, 96, 359 E, 284, 278, 183, 184; 206/315.3, 315.7

[56] References Cited

U.S. PATENT DOCUMENTS

| | | | |
|---|---|---|---|
| 1,791,188 | 2/1931 | Bright | 206/315.7 X |
| 1,954,413 | 4/1934 | Hunter | 248/96 |
| 2,016,967 | 10/1935 | Komers | 248/96 |
| 2,768,688 | 10/1956 | Santosuosso | 206/315.7 |
| 3,195,844 | 7/1965 | Roepke | 206/315.7 X |
| 3,787,017 | 1/1974 | Sauer | 248/359 E X |
| 4,087,068 | 5/1978 | Gardner | 248/359 E X |
| 4,226,389 | 10/1980 | Neth | 248/96 |
| 4,739,958 | 4/1988 | Sato | 248/96 |
| 4,798,357 | 1/1989 | Cho | 248/96 |

FOREIGN PATENT DOCUMENTS

| | | | |
|---|---|---|---|
| 6511457 | 7/1966 | Netherlands | 248/188.6 |

*Primary Examiner*—Ramon O. Ramirez

*Attorney, Agent, or Firm*—Don J. Flickinger; Jordan M. Meschkow; Lowell W. Gresham

[57] ABSTRACT

A supporting device which attaches to a wide variety of containers and exhibits a first, unobtrusive position for storing or transporting a container and a second, supporting position for holding the container in an upright orientation is disclosed. A bracket attaches either directly to the container or to a strap which in turn attaches to the container. The bracket rotationally couples to the first and second legs. When the legs are in their first positions, they reside substantially parallel to each other and immediately next to the container. However, when the legs are in their second positions, they extend outward from the container and at an angle with each other. Consequently, the legs and the container form a tripod which maintains the container in the upright orientation. Various blocking structures are provided in connection with the bracket and legs to prevent rotation of the legs beyond their first and second positions. In addition, springs lightly urge the legs to remain in their first positions.

7 Claims, 2 Drawing Sheets

FIG. 5
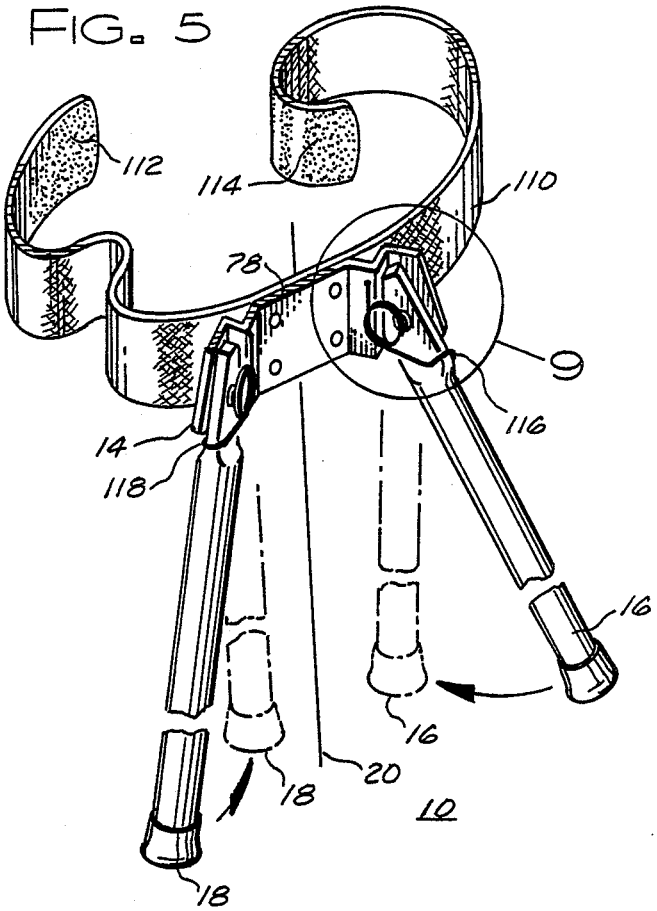
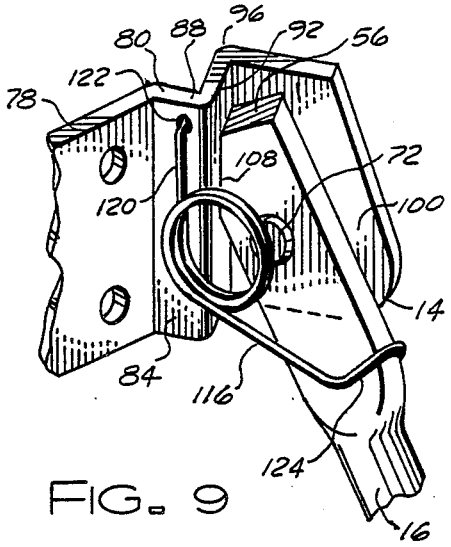
FIG. 9
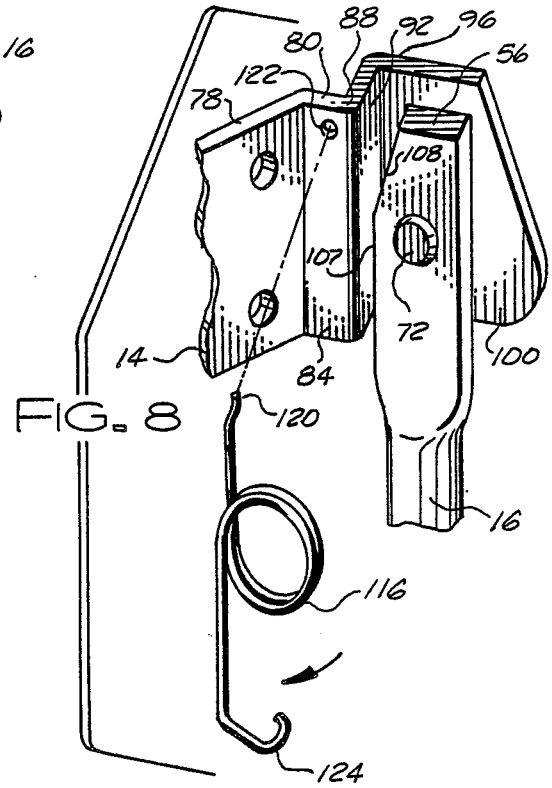
FIG. 8
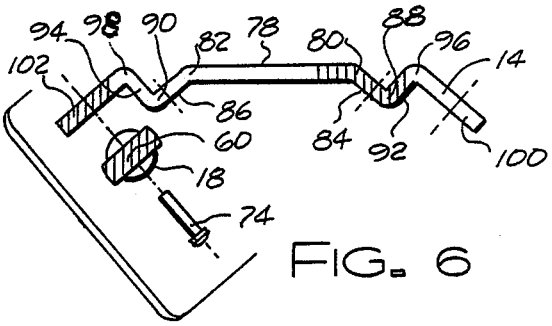
FIG. 6
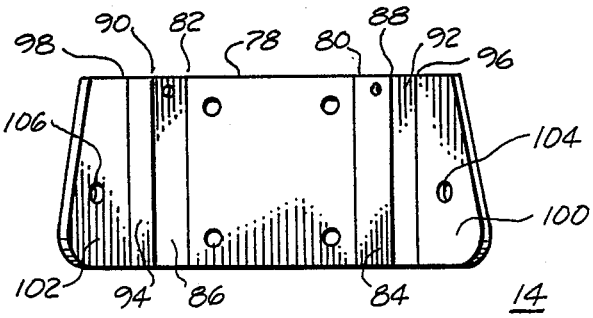
FIG. 7

CONTAINER STAND

TECHNICAL FIELD OF THE INVENTION

The present invention relates generally to supporting structures for devices, such as containers, boxes, carrying cases, bags, and the like. More specifically, the present invention relates to a supporting structure which maintains a device in an upright orientation so that the weight of the device is distributed between the device and the supporting structure.

BACKGROUND OF THE INVENTION

Many containers which are designed for storing and transporting valuable objects operate well for those purposes but fail to address the specific needs associated with the removal of the objects from the container. For example, if the container holds a plurality of objects and a user wishes to remove only a specific one of the objects, then the user must select the desired object from all of the objects in the container.

In order for a user to see the container contents so that the desired one of the objects contained therein may be selected, the container must often be placed in an upright orientation, wherein a container opening faces generally upward so that it faces the user's eyes. However, conventional prior art containers, such as tube shapes, bags, rectangular shapes, and the like, occasionally place the container opening on a side which does not normally face upward when the container is placed on a surface. Consequently, the user faces undesirable choices in selecting a desired one of the objects in the container.

To select a desired object, the user may elect to hold the container in an upright orientation so that the user can see into the container to select and remove only the desired object. This procedure is inconvenient and undesirable because it ties up the user's hands so that the user cannot continue to hold other objects while retrieving a desired object from the container. Moreover, in many situations, large or flexible containers are configured so that two hands are required to hold such containers in an upright position without spilling multiple objects contained therein. In such situations the election to hold a container in an upright orientation is extremely inconvenient and undesirable because two people may be required to remove the desired object.

Alternatively, to select a desired object the user may elect to remove all objects from a conventional container, spread such objects on a surface where they may be readily observed, and select the desired object. The removal of all objects in the container is also inconvenient and undesirable because it necessitates the use of a suitable surface, which is often unavailable, and the additional step of replacing all the unselected objects back into the container. This additional step is time consuming and imposes an added potential risk of loss or harm on the unselected objects.

The above-mentioned possibilities are even more undesirable when the objects held by the container are unusually sensitive or expensive and therefore preferably handled as little as possible. Moreover, these problems are again exacerbated when the objects held by the container are repeatedly removed and returned to the container in the course of normal use.

SUMMARY OF THE INVENTION

Accordingly, it is a advantage of the present invention that a support which holds a container in an upright orientation is provided.

Another advantage is that the present invention is configured to operate in two modes wherein it may selectively support a container or be unobtrusively positioned adjacent to the container.

Yet another advantage is that the present invention is configured to operate in connection with a wide variety of conventional containers without requiring modification of such conventional containers.

The above and other advantages of the present invention are carried out in one form by a supporting apparatus which includes a bracket, a first leg, and a second leg. The bracket has an attachment plate which is securable to a suitable object, such as a container. Moreover, the bracket is configured to define a weightsupporting line, which represents the portion of the container that serves as a third leg of a tripod formed by the present invention and the object. The first and second legs movably couple to the bracket so that they may selectively reside in first and second positions. When the first and second legs are in their first positions, they are generally parallel to each other and to the weight-supporting line defined by the bracket. When the first and second legs are in their second positions, they each form an acute angle with the weight-supporting line and an angle with each other.

BRIEF DESCRIPTION OF THE DRAWINGS

A more complete understanding of the present invention may be derived by referring to the detailed description and claims when considered in connection with the FIGURES, wherein like reference numbers refer to similar items throughout the FIGURES, and:

FIG. 5 shows an enlarged perspective view of a second embodiment of the present invention;

FIG. 6 shows a top view of the second embodiment of the present invention;

FIG. 7 shows a side view of a bracket portion of the second embodiment of the present invention;

FIG. 8 shows a detailed view of a leg in its first position coupled to the bracket portion of the second embodiment of the present invention; and FIG. 9 shows a detailed view of a leg in its second position coupled to a bracket portion of the second embodiment of the present invention.

DETAILED DESCRIPTION OF THE PREFERRED EMBODIMENTS

Figure 1:
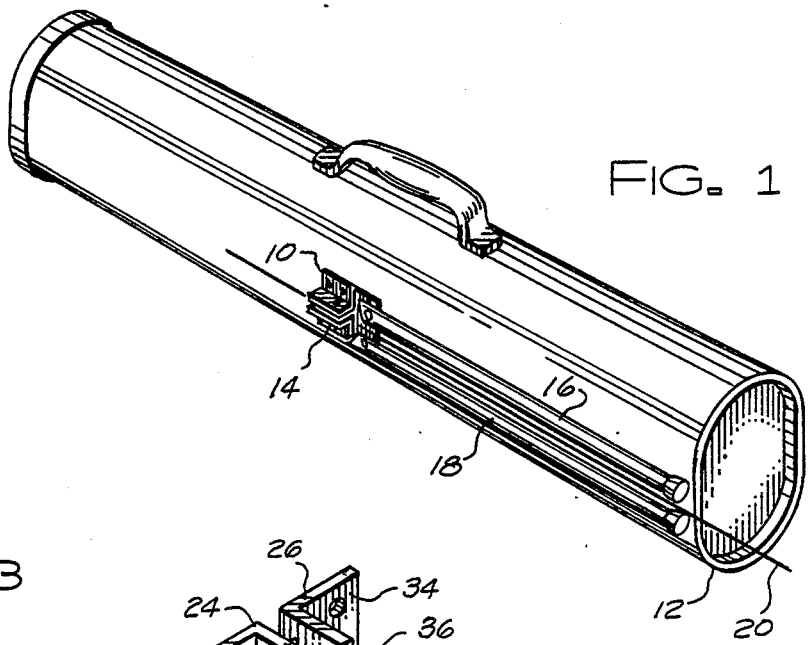
FIG. 1 shows a perspective view of the present invention attached to a container with legs of the present invention in a first position.
Figure 2:
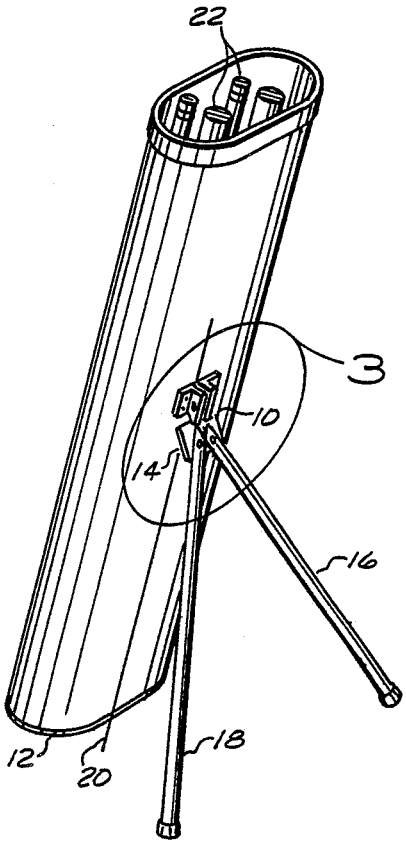
FIG. 2 shows a perspective view of the present invention attached to a container with legs of the present invention in a second position.

FIGS. 1 and 2 each show the present invention as a support 10 which attaches to a container 12. Support 10 includes a bracket 14, a first leg 16, and a second leg 18. Bracket 14 immovably attaches to container 12, and legs 16–18 are movable relative to bracket 14. The attachment of bracket 14 occurs in a central area of the exterior of container 12. FIG. 1 illustrates the present invention with legs 16–18 each in a first position, and FIG. 2 illustrates the present invention with legs 16–18 each in a second position.

When legs 16–18 are in their first positions (see FIG. 1), legs 16–18 are substantially parallel to each other. In addition, in the first positions, legs 16–18 reside adjacent to container 12 and do not extend beyond the perimeter of container 12. With legs 16–18 in their first positions, container 12 is prepared for storage or transportation, and legs 16–18 are unobtrusively positioned so as not to interfere with such storage or transportation.

When in their first positions, legs 16–18 additionally reside substantially parallel to and near an imaginary weight-supporting line 20. Weight-supporting line 20 is defined by the orientation of bracket 14, and is shown in FIGS. 1–2 as being an imaginary line on the surface of container 12. Consequently, when support 10 is attached to container 12, the projection of weightsupporting line 20 on container 12 represents the portion of container 12 which serves as a third leg of a tripod formed with first and second legs 16–18, when in their second positions (see FIG. 2).

As shown in FIG. 2, support 10 operates to position container 12 in an upright orientation in which the weight of container 12 and contents 22 thereof is distributed between legs 16–18 and container 12, including contents 22. This upright orientation permits contents 22 to be readily observed so that desired ones of contents 22 may be selected and removed from container 12 without container 12 being hand-held and without requiring excessive handling or removal of non-desired ones of contents 22.

FIG. 2 illustrates container 12 as being a relatively rigid, tube-shaped object and contents 22 as being sections of a billiards cue. However, the present invention is in no way limited to such configurations of container 12 and contents 22. For example, container 12 may alternatively represent a flexible container, such as a sack or bag, where the weight supporting function is performed more by contents 22 than by container 12. In addition, container 12 may exhibit any of a wide variety of shapes and sizes. Furthermore, container 12 may alternatively hold golf clubs, baseball bats, other sporting items, medical instruments, scientific instruments, tools, or the like.

Figure 3:
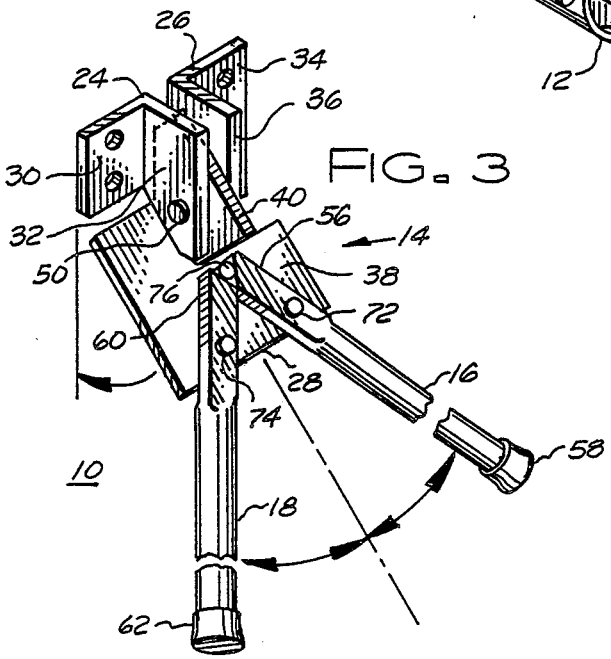
FIG. 3 shows an enlarged perspective view of a first embodiment of the present invention.
Figure 4:
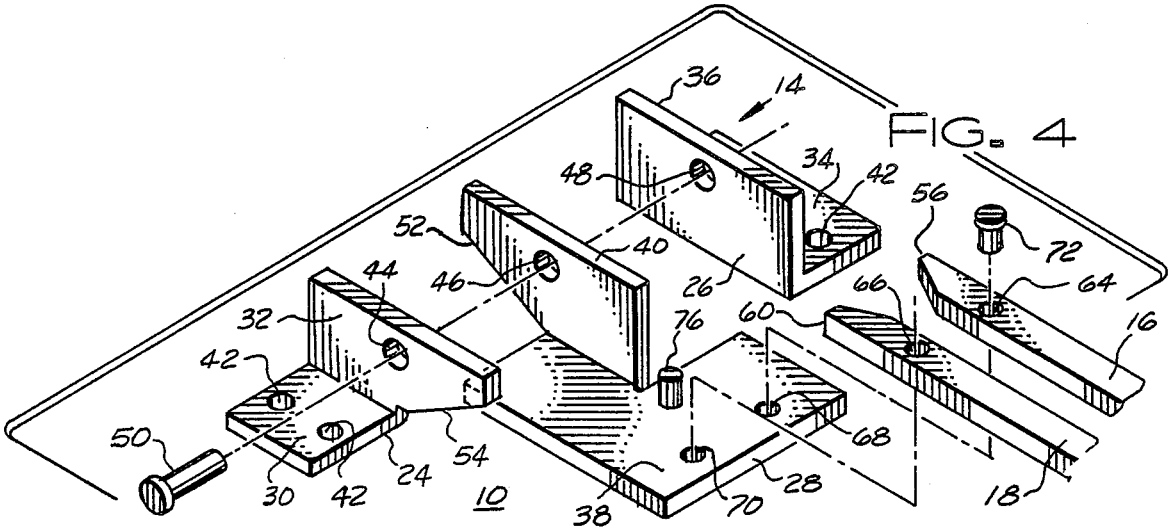
FIG. 4 shows an exploded view of the first embodiment of the present invention.

FIGS. 3 and 4 each show details of a first embodiment of support 10. FIG. 3 shows the components of support 10 operationally assembled with legs 16–18 in their second positions. FIG. 4 shows an exploded view of the components of support 10. With reference to FIGS. 3–4, bracket 14 includes left and right attachment members 24 and 26, respectively, and a rotating member 28. Left attachment member 24 includes an attachment plate 30 perpendicularly and rigidly attached at one end to a planar attachment support 32. Likewise, attachment member 26 includes an attachment plate 34 perpendicularly and rigidly attached at one end to a planar attachment support 36. Similarly, rotating member 28 includes a rotating plate 38 perpendicularly and rigidly attached to a planar rotating support 40. Each of members 24–28 may advantageously be formed into single integral units. attachment plates 30 and 34 couple to container 12 at surfaces thereof which oppose the direction in which supports 32 and 36, respectively, extend away from plates 30 and 34. FIGS. 3–4 illustrate such attachment through the use of holes 42 in connection with rivets or screws (not shown). However, the present invention contemplates the use of any conventional attaching technique, including a suitable adhesive.

When assembled, supports 32 and 36 reside parallel to and on opposing sides of support 40. Supports 32, 40, and 36 have aligned holes 44, 46, and 48, respectively, therethrough, and a pivot pin 50 extends through holes 44–48 to rotatably couple rotating member 28 to attachment members 24 and 26.

Rotating member 28 may selectively reside in or between two extreme positions. In a first position, which is illustrated in FIGS. 1 and 4, rotating plate 38 resides substantially coplanar with attachment plates 30 and 34. When attached to container 12, rotating plate 38 is prevented from rotating beyond this first position by container 12 (see FIG. 1).

In a second position, which is illustrated in FIGURES 2 and 3, rotating plate 38 has pivoted a small distance away from attachment plates 30 and 34 so that an obtuse angle forms therebetween. Rotating support 40 has an edge 52 (see FIG. 4) which faces container 12 and resides above pivot pin 50 when viewing FIG. 3. Edge 52 tapers outward from rotating plate 38 so that support 40 does not interfere with the rotation of rotating member 28 or damage container 12.

In addition, attachment support 32 overlies rotating plate 38 and has an edge 54 which tapers away from attachment plate 30 at an angle that defines this obtuse angle. Specifically, edge 54 abuts rotating plate 38 when rotating member 28 is in its second position and thereby prohibits rotation of rotating member 28 beyond the second position.

As shown in FIGS. 3–4, leg 16 has first and second ends 56 and 58, respectively, and leg 18 has first and second ends 60 and 62, respectively. Legs 16 and 18 are each generally tubular structures with flattened portions proximate first ends 56 and 60. Legs 16 and 18 additionally have holes 64 and 66, respectively, therethrough centrally located in these flattened portions. Rotating plate 38 has holes 68 and 70, and pivot pins 72 and 74 extend through holes 64 and 68, respectively, and holes 66 and 70, respectively, to rotatably couple first and second legs 16 and 18 to rotating plate 38.

As discussed above, legs 16 and 18 reside in first and second positions. Legs 16 and 18 are prohibited from extending beyond their first positions by mutual contact with each other. A blocking pin 76 is positioned on rotating plate 38 and extends outward therefrom to contact first ends 56 and 60 of legs 16 and 18, respectively, when legs 16 and 18 reach their second positions. Consequently, blocking pin 76 prohibits rotation of legs 16 and 18 beyond their second positions. Alternatively, as illustrated in FIG. 4, first ends 56 and 60 may be complementarily tapered so that they squarely abut each other as legs 16 and 18 reach their second positions. Thus, ends 56 and 60 may operate to block rotation of legs 16 and 18 beyond their second positions.

Thus, the carrying and storing position for legs 16 and 18, shown in FIG. 1, occurs when rotating member 28 is placed in its first position and when legs 16 and 18 are in their first positions. The supporting position for legs 16 and 18, shown in FIG. 2, occurs when rotating member 28 is placed in its second position and when legs 16 and 18 are in their second positions.

FIGS. 5–9 illustrate a second embodiment of support 10. As discussed above in connection with the first embodiment, support 10 includes bracket 14, first leg 16 and second leg 18. In addition, bracket 14 defines a weight-supporting line 20 as a result of the orientation of an attachment plate 78 thereof. However, the second embodiment of the present invention differs from the above-discussed first embodiment in the manner in which legs 16 and 18 couple to bracket 14.

FIGS. 6–7 illustrate details of bracket 14. In this second embodiment, bracket 14 is formed from a substantially planar plate to exhibit a non-planar shape. Specifically, attachment plate 78 of bracket 14 is substantially planar and has opposing ends 80 and 82. At ends 80 and 82, bracket 14 is bent at substantially identical obtuse angles with plate 78 in a first direction to form first and second angled plates 84 and 86, respectively. Plates 84 and 86 are each generally planar structures which extend from ends 80 and 82, respectively, to ends 88 and 90, respectively. At ends 88 and 90, bracket 14 bends in a second direction, which is opposite to the first direction, for approximately 90°to form blocking plates 92 and 94, respectively. Plates 92 and 94 are each generally planar structures which extend from ends 88 and 90, respectively, to ends 96 and 98, respectively. At ends 96 and 98, bracket 14 bends in the first direction for approximately 90°to form rotating plates 100 and 102, respectively.

Rotating plates 100 and 102 do not move relative to the other sections of bracket 14 but rotatably couple to legs 16 and 18, respectively (see FIG. 5). Specifically, rotating plates 100 and 102 have holes 104 and 106, respectively, therein. Legs 16 and 18 are configured substantially as described above in connection with the first embodiment. Consequently, pivot pins 72 and 74 extend through openings 64 and 66 in legs 16 and 18, respectively (see FIG. 4). In addition, pivot pins 72 and 74 extend through holes 104 and 106, respectively (see FIGS. 6–8) in this second embodiment.

Legs 16 and 18 each rotate between the first position and the second position. Phantom lines in FIG. 5 show legs 16 and 18 in their first positions while solid lines in FIG. 5 show legs 16 and 18 in their second positions. In addition, FIG. 8 shows leg 16 in the first position and FIG. 9 shows leg 16 in the second position. Referring to FIG. 8, leg 16 is prohibited from extending beyond its first position by contact between an edge portion 107 of leg 16 and blocking plate 92. Edge portion 107 resides on the opposite side of pivot pin 72 from first end 56, and faces blocking plate 92.

FIG. 9 shows leg 16 in its second position. An edge portion 108 of leg 16 also faces blocking plate 92 but resides on the same side of pivot pin 72 as first end 56. Consequently, rotation of leg 16 away from the first position causes edge portion 10B to contact blocking plate 92 when the second position of leg 16 is reached. Moreover, edge portion 108 tapers inward to define the angle at which leg 16 resides when in its second position. Thus, the mutual configuration of blocking plate 92 and edge portion 108 prevent rotation of leg 16 beyond its second position. Of course, although not specifically shown, those skilled in the art will recognize that leg 18 operates in the same manner as leg 16.

As shown in FIG. 5, the second embodiment of the present invention attaches to an attaching strap 110 rather than directly to container 12 (see FIGS. 1–2). For convenient and temporary attachment, strap 110 surrounds container 12 to attach support 10 thereto. In the preferred embodiment, strap 110 is a relatively flexible strap which has a first material 112 on an inward surface thereof and a second material 114 on an outward surface thereof. First and second materials 112 and 114 are conventional materials which releasably adhere to one another when pressed together, such as hook and loop fasteners commonly available under the trademark Velcro. Thus, strap 110 may be quickly attached to container 12 and quickly adjusted to tightly surround container 12. However, the present invention additionally contemplates the use of more rigid strapping materials for use in connection with flexible containers 12 and the use of alternative fastening devices.

With continued reference to FIGS. 5 and 8–9, the second embodiment of the present invention additionally includes springs 116 and 118 in connection with legs 16 and 18, respectively. FIGS. 8–9 illustrate the coupling between spring 116, leg 16, and bracket 14. Those skilled in the art will understand that spring 118 similarly operates with leg 18. Specifically, a first end 120 of spring 116 attaches to first angled plate 84 of bracket 14 at an opening 122 therethrough. A second end 124 exhibits a hook shape which couples directly to the perimeter of leg 16. Spring 116 is biased to urge leg 16 into its first position. Consequently, leg 16 tends to remain secured in its first position when not in its second position. The strength of spring 116 is relatively weak so that leg 16 remains in its second position when a proportionate share of the weight of container 12 is applied to leg 16. In addition, detents (not shown) may advantageously be provided between leg 16 and rotating plate 100 to lock leg 16 in its second position and prevent leg 16 from returning to its first position, even when no weight is on leg 16.

In summary, the present invention provides a support which selectively holds a container in an upright orientation so that contents of the container may be readily observed. With legs of the present invention in first positions, the present invention is unobtrusively positioned adjacent to the container. With the legs in second positions, the present invention may support the container in the upright orientation. Moreover, the present invention is easily attached and used in connection with a wide variety of container sizes, shapes, and materials without requiring modification of the containers.

The present invention has been described above with reference to a preferred embodiment. However, those skilled in the art will recognize that changes and modifications may be made in these preferred embodiments without departing from the scope of the present invention. These and other changes and modifications which are obvious to those skilled in the art are intended to be included within the scope of the present invention.

What is claimed is:

1. A supporting apparatus for attachment to an object to selectively position said object in an upright orientation, said supporting apparatus comprising:

(a) a bracket including (i) a planar attachment plate attachable to said object, said attachment plate defining a weight supporting line, and (ii) a planar attachment support perpendicularly and rigidly attached to said planar attachment plate;

(b) a rotating member pivotably attached to said attachment support, said rotating plate comprising (i) a planar rotating support coplanar with said planar attachment support, and (ii) a planar rotating plate perpendicularly and rigidly attached to said planar rotating support, said rotating member being disposed for rotation from a first position in which said rotating plate is generally coplanar with said planar attachment plate to a second position in which said rotating plate forms an angle with said attachment plate;

(c) a first leg movably coupled to said rotating plate so that said first leg selectively resides in one of a first position generally parallel to said weight supporting line and a second position at an acute angle to said weight supporting line; and (d) a second leg movably coupled to said rotating plate so that said second leg selectively resides in one of a first position generally parallel to said weight-supporting line and a second position at an acute angle to said weight-supporting line, said second leg being at an angle with said first leg when said first and second legs are in said second positions.

2. A supporting apparatus as claimed in claim 1, additionally comprising means, coupled to one of said bracket and said rotating member, for limiting rotation of said rotating member relative to said bracket so that movement beyond said second position of said rotating member is prohibited.

3. A supporting apparatus as claimed in claim 2, wherein:

(a) said attachment support comprises a portion overlying said rotating plate, and (b) said means for limiting rotation of said rotating member comprises an edge formed on said overlying portion of said rotating plate, said edge tapering away from said attachment plate at an obtuse angle and abutting said rotating plate when said rotating member is in said second position.

4. A supporting apparatus as claimed in claim 1, additionally comprising means, coupled to one of said rotating plate, said first leg, and said second leg, for limiting rotation of said first and second legs relative to said rotating plate so that movement beyond said second position of said first and second legs is prohibited.

5. A supporting apparatus as claimed in claim 4, wherein:

(a) said first leg has first and second ends, and said first leg couples to said rotating plate proximate said first leg first end;

(b) said second leg has fist and second ends, and said second leg couples to said rotating plate proximate said second leg first end;

(c) said second ends are closer together when said first and second legs are in said first positions than when said first and second legs are in said second positions.

6. A supporting apparatus as claimed in claim 5, wherein said means for limiting rotation of said first and second legs comprises a blocking pin extending outward from said rotating plate to contact said first ends of said first and second legs when said first and second legs are in said second positions.

7. A supporting apparatus as claimed in claim 4, wherein:

(a) said first ends of said first and second legs are complementarily tapered to squarely abut each other when said first and second legs are in said second positions; and (b) said means for limiting rotation of said first and second legs comprise said tapered ends.

* * * * *